US009540797B2

(12) United States Patent
Wu

(10) Patent No.: US 9,540,797 B2
(45) Date of Patent: Jan. 10, 2017

(54) ANTI-FREEZE FAUCET STRUCTURE

(71) Applicant: Cheng-Hsuan Wu, Lugang Township, Changhua County (TW)

(72) Inventor: Cheng-Hsuan Wu, Lugang Township, Changhua County (TW)

( * ) Notice: Subject to any disclaimer, the term of this patent is extended or adjusted under 35 U.S.C. 154(b) by 0 days.

(21) Appl. No.: 14/700,183

(22) Filed: Apr. 30, 2015

(65) Prior Publication Data

US 2016/0319523 A1 Nov. 3, 2016

(51) Int. Cl.
*E03B 7/12* (2006.01)

(52) U.S. Cl.
CPC ..... *E03B 7/12* (2013.01); *Y10T 137/5497* (2015.04)

(58) Field of Classification Search
CPC ..... E03B 7/12; E03B 9/027; E03B 7/10; E03B 9/14; Y10T 137/5497; Y10T 137/1189
USPC ..... 137/301
See application file for complete search history.

(56) References Cited

U.S. PATENT DOCUMENTS 6,805,154 B1 * 10/2004 Dickey et al. ..... E03B 7/10 137/218
8,613,290 B1 * 12/2013 Wu ..... F16K 3/08 137/218
8,707,982 B2 * 4/2014 Wu ..... E03B 9/027 137/218
9,234,333 B2 * 1/2016 Ko ..... E03B 7/12
9,249,561 B2 * 2/2016 Wu ..... E03B 9/027

* cited by examiner

*Primary Examiner* — Kevin Lee
(74) *Attorney, Agent, or Firm* — Alan D. Kamrath; Kamrath IP Lawfirm, P.A.

(57) ABSTRACT

An anti-freeze faucet structure contains: a first pipe, a second pipe, a first control valve, a spring, a check valve, and a second control valve. The first pipe includes an orifice, an outlet, an inlet, a stop rim, and an inner screwing section. The second pipe is disposed in the first pipe and includes an aperture and a rotatable knob. The first control valve is joined with the second pipe and includes a through hole, an outer screwing section, a water passage, and a water channel. The spring is mounted in the through hole and is stopped by a limiting rib. The check valve is secured in the through hole and includes a stopping plug and a water stop portion. The second control valve is connected with the water channel to position the spring and the check valve and includes an inlet channel and a close ring.

10 Claims, 8 Drawing Sheets

ANTI-FREEZE FAUCET STRUCTURE

BACKGROUND OF THE INVENTION

Field of the Invention

The present invention relates to an anti-freeze faucet structure and, more particularly, to a rotatable anti-freeze faucet structure which avoids water accumulation when starting and then stopping water.

Description of the Prior Art

A conventional anti-freeze faucet is used in a low-temperature environment to prevent water from freezing therein because the water does not discharge completely. To further avoid foul water polluting an inlet pipe of the anti-freeze faucet in a vacuum siphon effect after stopping the water supply, a check structure is arranged in the anti-freeze faucet structure. Preferably, a vacuum breaking device is fixed in the anti-freeze faucet structure to prevent the anti-freeze faucet structure being broken by frozen water or being frozen. The vacuum breaking device is employed to flow air after starting and then stopping the water supply.

The anti-freeze faucet contains a rotatable screwing control valve or a rotatable moving control valve made of ceramics material. The rotatable moving control valve allows breaking vacuum after starting and then stopping the water supply. However, the ceramics material is expensive. The rotatable screwing control valve is manufactured at a low cost, but the vacuum cannot be broken after starting and then stopping the water supply.

The present invention has arisen to mitigate and/or obviate the afore-described disadvantages.

SUMMARY OF THE INVENTION

The primary objective of the present invention is to provide an anti-freeze faucet structure in which an inner screwing section of a first pipe screws with an outer screwing section of a first control valve to open or close an inlet. The first control valve and a second control valve are moved upwardly or downwardly, and a spring matches with a check valve. When the first control valve and the second control valve move upwardly or downwardly, a stopping plug and a water stop portion of the check valve correspondingly move. When the stopping plug opens a water channel, the water stop portion stops flowing water between an aperture and a water passage, and when the stopping plug closes the water channel, the water stop portion starts flowing the water between the aperture and the water passage, thus starting or stopping the water at a low cost. In addition, a vacuum is broken after starting and then stopping the water.

An anti-freeze faucet structure provided by the present invention contains: a first pipe, a second pipe, a first control valve, a spring, a check valve, and a second control valve.

The first pipe includes an orifice defined on a first end thereof, an outlet adjacent to the orifice, an inlet formed on a second end thereof, a stop rim arranged on an inner wall thereof proximate to the inlet, and an inner screwing section arranged therein.

The second pipe is hollow and includes an aperture defined on one end thereof and communicating therewith. The second pipe also includes a rotatable knob mounted on a top end thereof, and the second pipe is disposed in the first pipe.

The first control valve is joined with the second pipe by using its upper end and includes a through hole formed therein and communicating with the aperture. The first control valve also includes an outer screwing section arranged, around an outer wall of a lower end thereof to screw with the inner screwing section of the first pipe. The second pipe is rotated to control the first control valve to move upwardly or downwardly. The first control valve further includes a water passage above the outer screwing section and a water channel formed in the lower end thereof adjacent to the outer screwing section.

The spring is mounted in the through hole of the first control valve and its first end is stopped by a limiting rib in the through hole.

The check valve is secured in the through hole of the first control valve and is pushed by a second end of the spring. The cheek valve includes a stopping plug fixed on a first end thereof, and the stopping plug moves to open an opening of the check valve or to close the water channel of the first control valve. The check valve also includes a water stop portion for starting or stopping water among the aperture and the water passage. When the stopping plug opens the water channel, the water stop portion stops water between the aperture and the water passage, and when the stopping plug closes the water channel, the water stop portion starts the water between the aperture and the water passage.

The second control valve is connected with the water channel of the first control valve by its first end to position the spring and the check valve, and the second control valve also includes an inlet channel arranged on an outer wall thereof and a close ring disposed on a second end thereof.

DETAILED DESCRIPTION OF THE PREFERRED EMBODIMENTS

Figure 1:
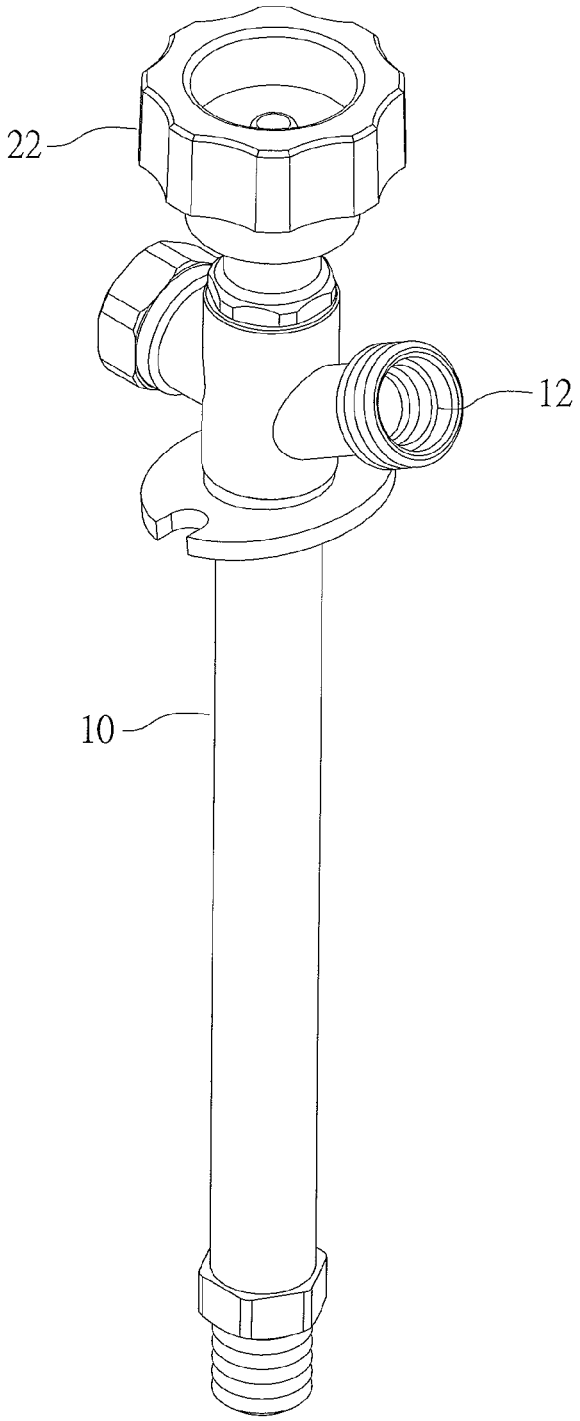
FIG. 1 is a perspective view showing the assembly of an anti-freeze faucet structure in accordance with a preferred embodiment of the present invention.
Figure 2:
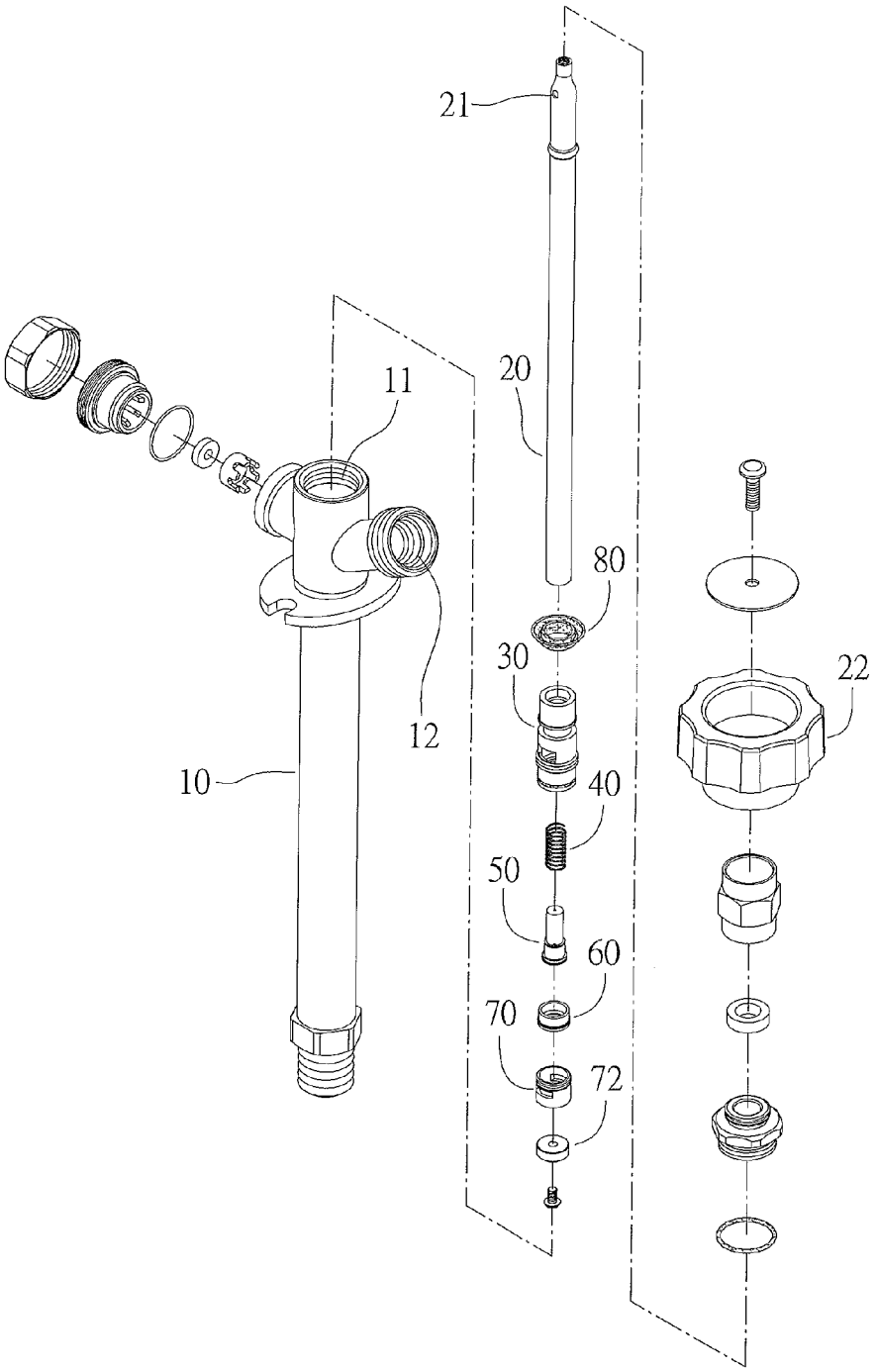
FIG. 2 is a perspective view showing the exploded components of the anti-freeze faucet structure in accordance with the preferred embodiment of the present invention.
Figure 3:
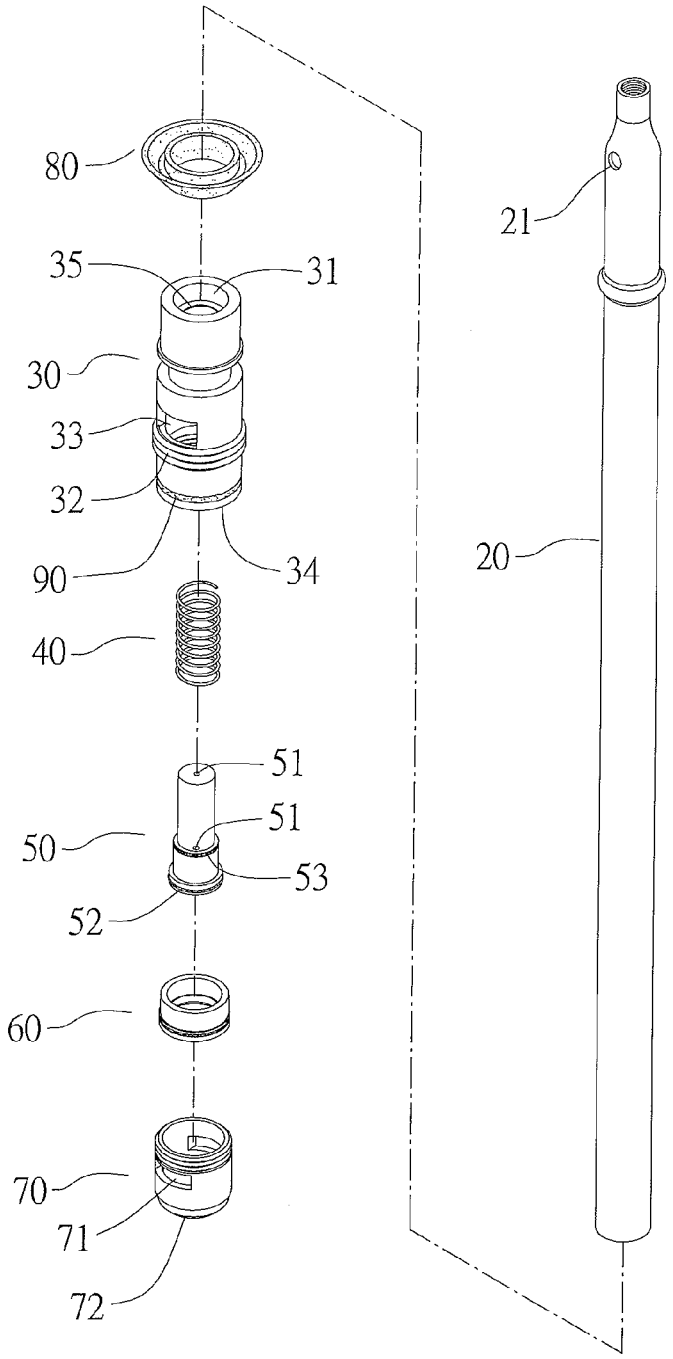
FIG. 3 is a perspective view showing the exploded components of a part of the anti-freeze faucet structure in accordance with the preferred embodiment of the present invention.
Figure 4:
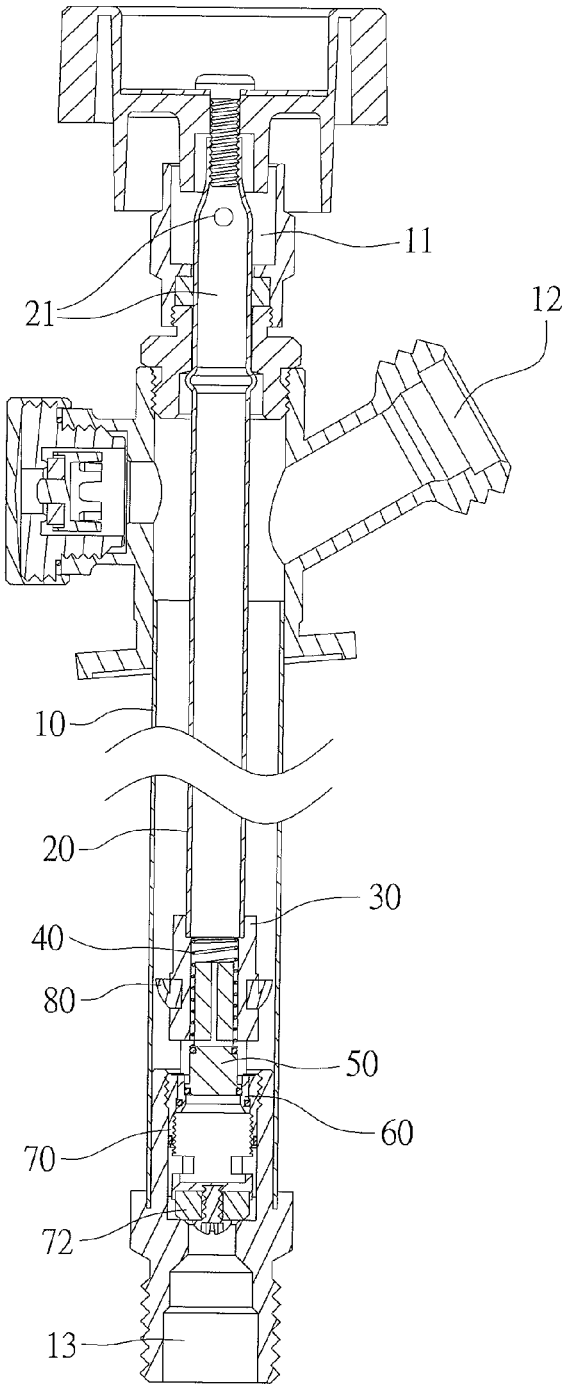
FIG. 4 is a cross sectional view showing the assembly of the anti-freeze faucet structure in accordance with the preferred embodiment of the present invention.

The present invention will be clearer from the following description when viewed together with the accompanying drawings, which show, for purpose of illustration only, the preferred embodiments in accordance with the present invention.

Referring to FIGS. 1-5, an anti-freeze faucet structure according to a preferred embodiment of the present invention comprises a first pipe 10 including an orifice 11 defined on a first end thereof, an outlet 12 adjacent to the orifice 11, an inlet 13 formed on a second end thereof, a stop rim 14 arranged on an inner wall thereof proximate to the inlet 13, and an inner screwing section 15 arranged therein. The inner screwing section 15 is a multiple thread;

A second pipe 20 is hollow and includes an aperture 21 defined on one end thereof and communicating therewith. The second pipe 20 also includes a rotatable knob 22 mounted on a top end thereof, and the second pipe 20 is disposed in the first pipe 10.

A first control valve 30 is joined with the second pipe 20 by using its upper end and includes a through hole 31 formed therein and communicating with the aperture 21. The first control valve 30 also includes an outer screwing section 32 arranged around an outer wall of a lower end thereof to screw with the inner screwing section 15 of the first pipe 10. The second pipe 20 is rotated to control the first control valve 30 to move upwardly or downwardly, and the outer screwing section 32 is a multiple thread. The first control valve 30 further includes a water passage 33 above the outer screwing section 32 and a water channel 34 formed in the lower end thereof adjacent to the outer screwing section 32.

A spring 40 is mounted in the through hole 31 of the first control valve 30, and its first end is stopped by a limiting rib 35 in the through hole 31.

A check valve 50 is secured in the through hole 31 of the first control valve 30 and pushed by a second end of the spring 40. The check valve 50 includes an opening 51 defined in a first end thereof and extending to an intermediate section thereof. The check valve 50 also includes a stopping plug 52 fixed on a second end thereof. The opening 51 is closed or is opened in the through hole 31, and the stopping plug 52 moves to open the opening 51 or to close the water channel 34 of the first control valve 30. The check valve 50 further includes a water stop portion 53 for starting or stopping water between the aperture 21, the opening 51, and the water passage 33. When the stopping plug 52 opens the water channel 34, the water stop portion 53 stops water between the aperture 21 and the water passage 33. When the stopping plug 52 closes the water channel 34, the water stop portion 53 starts the water between the aperture 21 and the water passage 33.

A closing sleeve 60 is secured in the water channel 34 of the first control valve 30 to stop the second end of the check valve 50 and to close the water channel 34 with the stopping plug 52.

A second control valve 70 includes threads formed on a first end thereof to screw with the water channel 34 of the first control valve 30 and to position the spring 40, the check valve 50, and the closing sleeve 60. The second control valve 70 also includes an inlet channel 71 arranged on an outer wall thereof and a close ring 72 disposed on a second end thereof.

A single-direction washer 80 is connected with the second pipe 20 between the outlet 12 of the first pipe 10 and the water passage 33 of the first control valve 30, and the single-direction washer 80 is also coupled with the first control valve 30. The water or air flows toward the outlet 12 of the first pipe 10 only.

Furthermore, at least one sealing ring 90 is fixed on the stopping plug 52 and the water stop portion 53 of the check valve 50, between the closing sleeve 60 and the first control valve 30, and between the outer screwing section 32 of the first control valve 30 adjacent to the inlet 13 and the first pipe 10.

Figure 5:
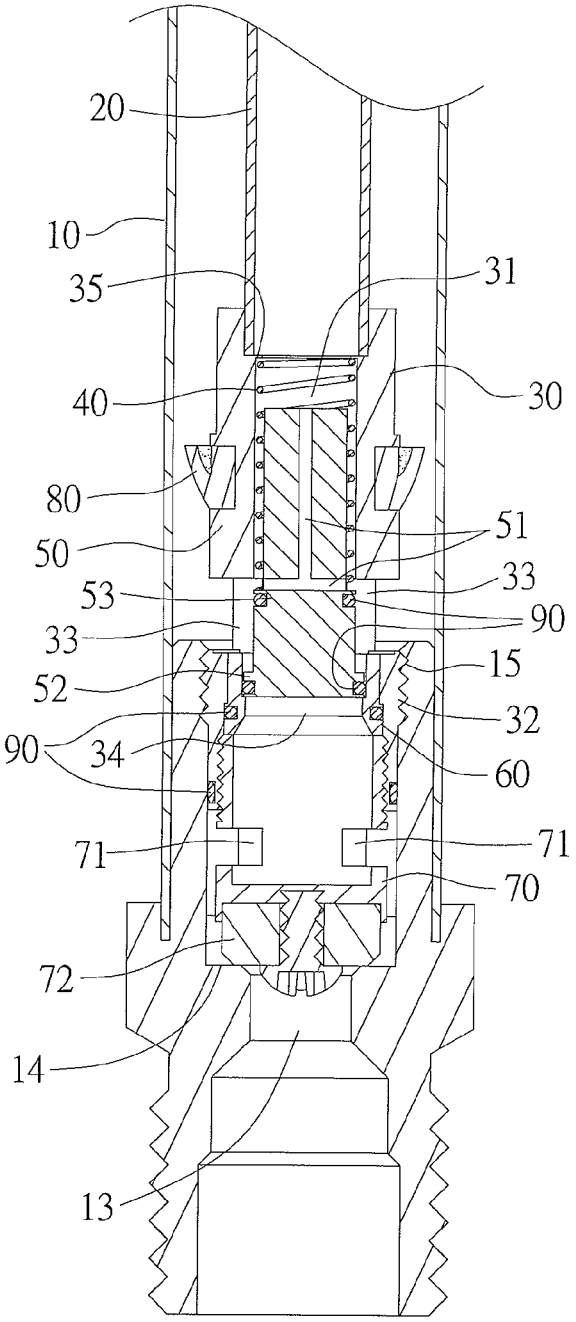
FIG. 5 is a cross sectional view showing the operation of a part of the anti-freeze faucet structure in accordance with the preferred embodiment of the present invention.

As the anti-freeze faucet structure is not turned on, as shown in FIG. 5, the second pipe 20 moves downwardly to press the first control valve 30 and the second control valve 70, and the close ring 72 closes the inlet 13 of the first pipe 10. The spring 40 and the check valve 50 are not influenced by an external force, and the spring 40 pushes the check valve 50 so that the stopping plug 52 closes the water channel 34.

Figure 6:
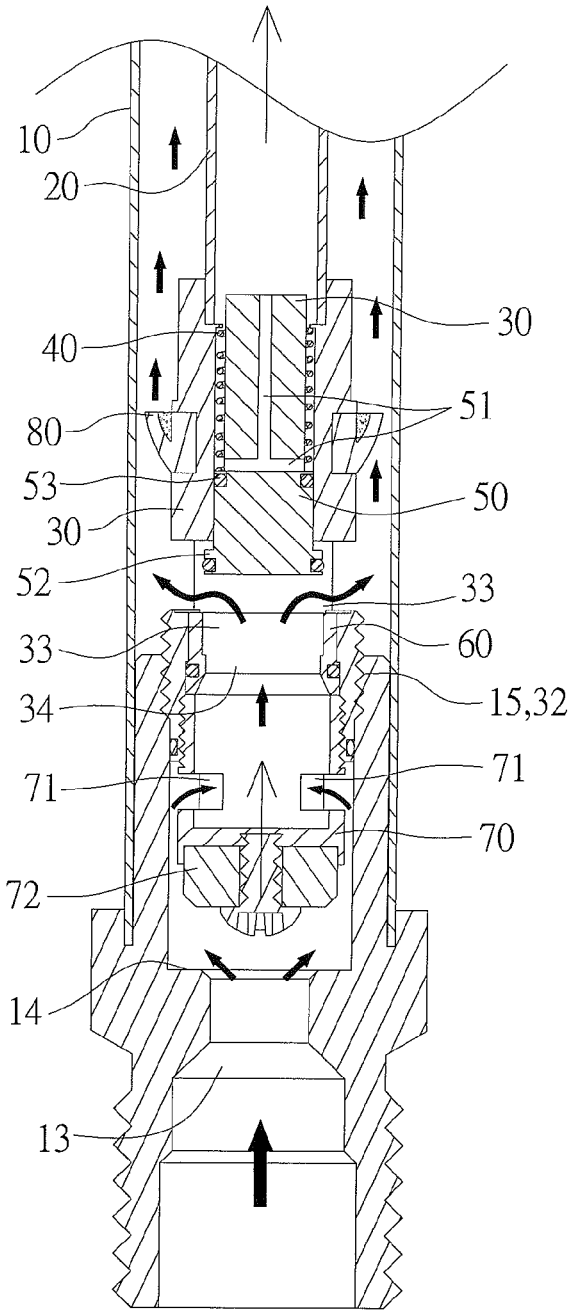
FIG. 6 is another cross sectional view showing the operation of a part of the anti-freeze faucet structure in accordance with the preferred embodiment of the present invention.

When turning on the anti-freeze faucet structure, the rotatable knob 22 of the second pipe 20 drives the first control valve 30 to rotate, and then the water flows into the anti-freeze faucet structure, as illustrated in FIG. 6. Thereafter, the outer screwing section 32 of the first control valve 30 screws with the inner screwing section 15 of the first pipe 10 to drive the second control valve 70 to move upwardly, the close ring 72 opens the inlet 13 to flow the water into the anti-freeze faucet structure from the inlet channel 71, and the check valve 50 is pushed by water pressure to push the spring 40, thus turning on the water channel 34. Thereafter, the water stop portion 53 moves to stop the water between the aperture 21 and the water passage 33, and the water flows out of the outlet 12 of the first pipe 10 from the water channel 34 through the water passage 33.

Figure 7:
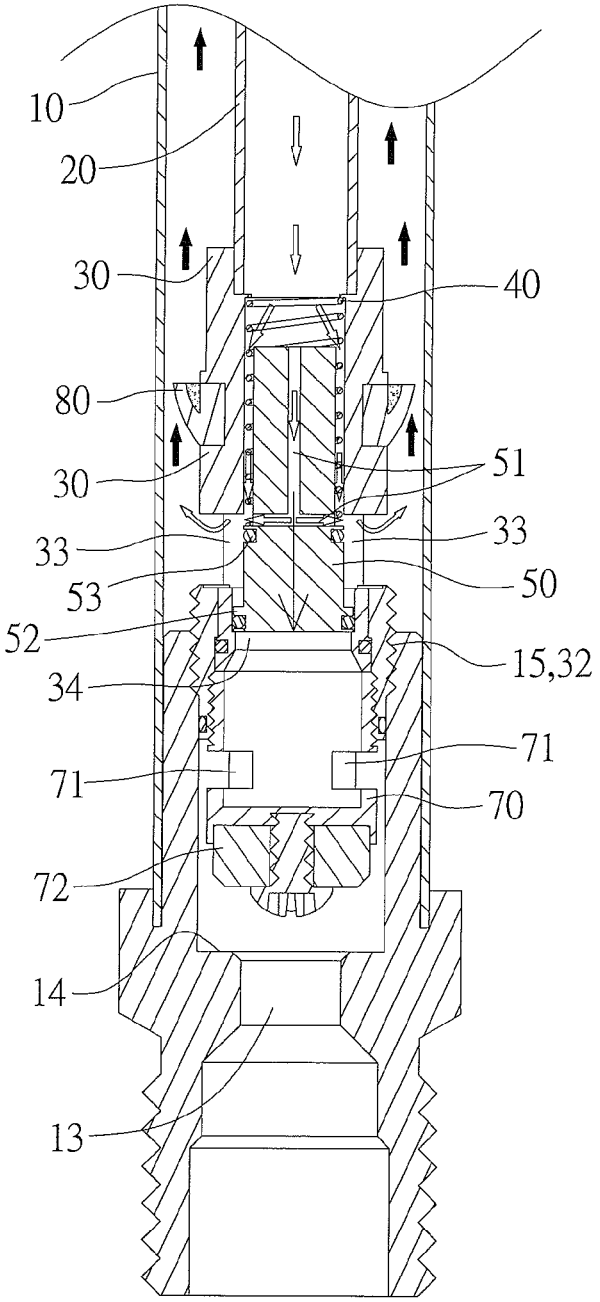
FIG. 7 is also another cross sectional view showing the operation of a part of the anti-freeze faucet structure in accordance with the preferred embodiment of the present invention.

As illustrated in FIG. 7, after starting and then stopping the water, the water flows into the water channel 34 from the inlet 13 and then flows out of the outlet 12 of the first pipe 10 via the water passage 33. When stopping the water, the water stops flowing into the inlet 13. Hence, the check valve 50 is not pushed by the water pressure, and the spring 40 pushes the check valve 50 so that the stopping plug 52 closes the water channel 34, and the water stop portion 53 moves to open the water between the aperture 21 and the water passage 33, by which a vacuum between the first pipe 10 and the first control valve 30 is broken. Thereafter, the water between the first pipe 10 and the first control valve 30 flows out of the outlet 12 through the single-direction washer 80.

Figure 8:
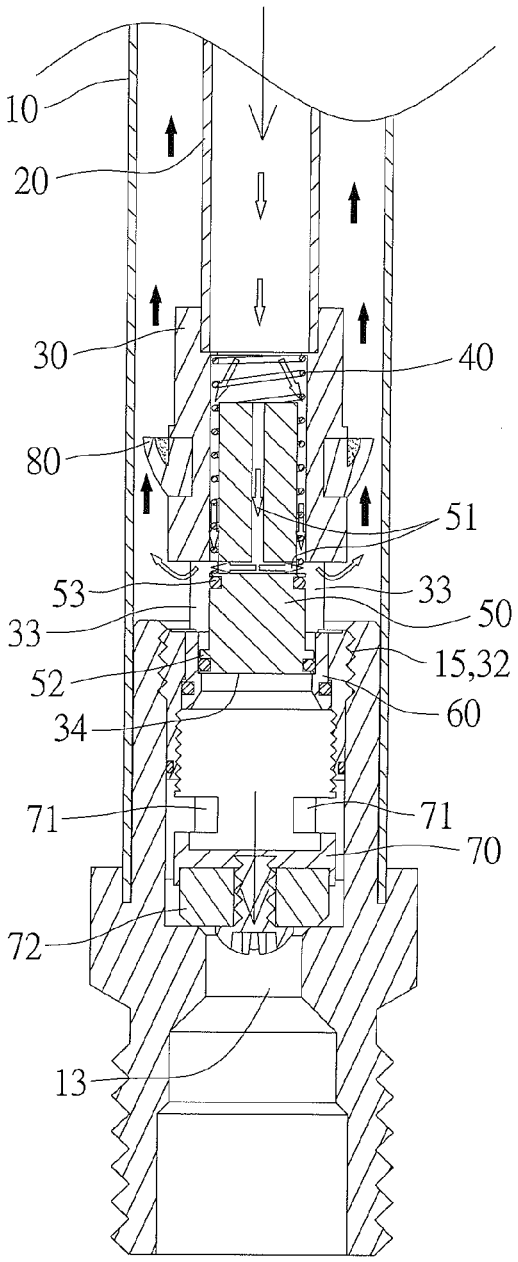
FIG. 8 is still another cross sectional view showing the operation of a part of the anti-freeze faucet structure in accordance with the preferred embodiment of the present invention.

When desiring to stop the water, as illustrated in FIG. 8, the rotatable knob 22 of the second pipe 20 is rotated to drive the first control valve 30 to revolve, the outer screwing section 32 of the first control valve 30 reversely rotates with the inner screwing section 15 of the first pipe 10 to drive the second control valve 70 to descend, and then the close ring 72 closes the inlet 13, thus stopping the water flowing into the inlet 13. Thereafter, the water pressure does not push the check valve 50, and the spring 40 pushes the check valve 50 back to an original so that the stopping plug 52 closes the water channel 34. Hence, the water stop portion 53 moves to start flowing the water between the aperture 21 and the water passage 33, thus eliminating the vacuum between the first pipe 10 and the first control valve 30. Preferably, the water keeps flowing out of the outlet 12 through the single-direction washer 80.

Accordingly, the anti-freeze faucet structure of the present invention has advantages as follows. The inner screwing section 15 of the first pipe 10 screws with the outer screwing section 32 of the first control valve 30, the inlet 13 is opened or closed, and the first control valve 30 and the second control valve 70 are moved upwardly or downwardly. Preferably, the spring 40 matches with the check valve 50 so that when the first control valve 30 and the second control valve 70 move upwardly or downwardly, the stopping plug 52 and the water stop portion 53 of the check valve 50 correspondingly move. When the stopping plug 52 opens the water channel 34, the water stop portion 53 stops flowing the water between the aperture 21 and the water passage 33, while the stopping plug 52 closes the water channel 34, the water stop portion 53 starts flowing the water between the aperture 21 and the water passage 33, thus starting or stopping the water at a low cost. In addition, the vacuum is broken after starting and then stopping the water.

While various embodiments in accordance with the present invention have been shown and described, it is clear to those skilled in the art that further embodiments may be made without departing from the scope of the present invention.

What is claimed is:

1. An anti-freeze faucet structure comprising:

a first pipe including an orifice defined on a first end thereof, an outlet adjacent to the orifice, an inlet formed on a second end thereof, a stop rim arranged on an inner wall thereof proximate to the inlet, and an inner screwing section arranged therein;

a second pipe being hollow and including an aperture defined on one end thereof and communicating therewith, with the second pipe also including a rotatable knob mounted on a top end thereof, wherein the second pipe is disposed in the first pipe;

a first control valve joined with the second pipe by using an upper end and including a through hole formed therein and communicating with the aperture, with the first control valve also including an outer screwing section arranged around an outer wall of a lower end thereof to screw with the inner screwing section of the first pipe, wherein the second pipe is rotated to control the first control valve to move upwardly or downwardly; with the first control valve further including a water passage above the outer screwing section and a water channel formed in the lower end thereof adjacent to the outer screwing section;

a spring mounted in the through hole of the first control valve and having a first end stopped by a limiting rib in the through hole;

a check valve secured in the through hole of the first control valve and pushed by a second end of the spring, with the check valve including a stopping plug fixed on a first end thereof, wherein the stopping plug moves to open an opening of the check valve or to close the water channel of the first control valve, with the check valve also including a water stop portion for starting or stopping water between the aperture and the water passage; wherein when the stopping plug opens the water channel, the water stop portion stops water between the aperture and the water passage; and wherein when the stopping plug closes the water channel, the water stop portion starts the water between the aperture and the water passage; and a second control valve connected with the water channel of the first control valve by a first end to position the spring and the check valve, with the second control valve also including an inlet channel arranged on an outer wall thereof and a close ring disposed on a second end thereof.

2. The anti-freeze faucet structure as claimed in claim 1, wherein the inner screwing section and the outer screwing section are a multiple thread.

3. The anti-freeze faucet structure as claimed in claim 1, wherein the second control valve includes threads formed on the second end thereof to screw with the water channel of the first control valve.

4. The anti-freeze faucet structure as claimed in claim 1, wherein the check valve also includes the opening defined in a second end thereof and extending to an intermediate section thereof, with the check valve also including a stopping plug fixed on a second end thereof, and wherein the opening is closed or is opened in the through hole.

5. The anti-freeze faucet structure as claimed in claim 1, wherein at least one sealing ring is fixed on the stopping plug and the water stop portion of the check valve and between the outer screwing section of the first control valve adjacent to the inlet and the first pipe.

6. The anti-freeze faucet structure as claimed in claim 1 further comprising: a single-direction washer connected with the second pipe between the outlet of the first pipe and the water passage of the first control valve, wherein the water or air flows toward the outlet of the first pipe only.

7. The anti-freeze faucet structure as claimed in claim 6, wherein the single-direction washer is also coupled with the first control valve.

8. The anti-freeze faucet structure as claimed in claim 1, wherein at least one sealing ring is fixed on the stopping plug and the water stop portion of the check valve, between a closing sleeve and the first control valve, and between the outer screwing section of the first control valve adjacent to the inlet and the first pipe.

9. The anti-freeze faucet structure as claimed in claim 1 further comprising a closing sleeve secured in the water channel of the first control valve to stop a second end of the check valve and to close the water channel with the stopping plug.

10. The anti-freeze faucet structure as claimed in claim 9, wherein a sealing ring is fixed between the closing sleeve and the first control valve.

* * * * *